US008506165B2

(12) United States Patent
Shinozaki et al.

(10) Patent No.: US 8,506,165 B2
(45) Date of Patent: Aug. 13, 2013

(54) EASILY OPENABLE PACKAGING BAG

(75) Inventors: Kousuke Shinozaki, Fujioka (JP); Akio Yohtoh, Fujioka (JP); Tadayuki Koyanagi, Fujioka (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 284 days.

(21) Appl. No.: 12/863,059

(22) PCT Filed: Jan. 13, 2009

(86) PCT No.: PCT/JP2009/050282

§ 371 (c)(1),
(2), (4) Date: Jul. 15, 2010

(87) PCT Pub. No.: WO2009/090930

PCT Pub. Date: Jul. 23, 2009

(65) Prior Publication Data

US 2010/0290723 A1 Nov. 18, 2010

(30) Foreign Application Priority Data

Jan. 15, 2008 (JP) ..... 2008-006301

(51) Int. Cl.
*B65D 33/00* (2006.01)
*B65D 65/26* (2006.01)

(52) U.S. Cl.
USPC ..... 383/207; 229/87.05

(58) Field of Classification Search
USPC ..... 229/87.05; 383/207, 208, 200–202, 383/107, 116, 66
See application file for complete search history.

(56) References Cited

U.S. PATENT DOCUMENTS

| | | | | | |
|---|---|---|---|---|---|
| 4,290,526 | A | * | 9/1981 | Haiss | 383/203 |
| 5,229,180 | A | * | 7/1993 | Littmann | 428/43 |
| 5,437,881 | A | * | 8/1995 | Jeannin | 426/122 |
| 5,934,809 | A | * | 8/1999 | Marbler | 383/208 |
| 6,065,591 | A | * | 5/2000 | Dill et al. | 206/233 |
| 6,126,317 | A | * | 10/2000 | Anderson et al. | 383/207 |

(Continued)

FOREIGN PATENT DOCUMENTS

| | | |
|---|---|---|
| JP | 64-36435 A | 2/1989 |
| JP | 3-29487 U | 3/1991 |

(Continued)

OTHER PUBLICATIONS

Machine translation of Japanese Document No. 2007-210633.*

(Continued)

*Primary Examiner* — Jes F Pascua
(74) *Attorney, Agent, or Firm* — Sughrue Mion, PLLC

(57) ABSTRACT

An easily openable packaging bag according to the present invention does not produce an opening piece resulting in a small piece of waste when opening, and facilitates opening even with a single hand. Furthermore the easily openable packaging bag of the present invention can be also applied to a packaging bag provided with barrier characteristics. The easily openable packaging bag joins both ends of a packaging material into a tube shape. Both of the joined ends are heat sealed to form a bonded rear portion in a rear portion of the tube portion and solid contents are contained in an inner section of the tube portion. A weakened portion is formed in a portion not occupied by the contents in the tube portion along a circumferential direction of the tube portion and the weakened portion is not provided in at least a portion of the bonded rear portion.

2 Claims, 8 Drawing Sheets

(56) References Cited

U.S. PATENT DOCUMENTS

| | | | | |
|---|---|---|---|---|
| 6,173,554 | B1 * | 1/2001 | Marbler | 53/412 |
| 6,945,391 | B2 * | 9/2005 | Moodie | 206/204 |
| 2002/0052280 | A1 | 5/2002 | Komatsu | |
| 2003/0019780 | A1 * | 1/2003 | Parodi et al. | 206/524.1 |
| 2003/0142888 | A1 * | 7/2003 | Provost et al. | 383/66 |
| 2004/0226848 | A1 * | 11/2004 | Dunn-Rankin | 206/461 |
| 2008/0115458 | A1 * | 5/2008 | Funaki et al. | 53/373.7 |
| 2008/0273821 | A1 * | 11/2008 | Doll | 383/209 |
| 2011/0253771 | A1 * | 10/2011 | Willey et al. | 229/87.05 |

FOREIGN PATENT DOCUMENTS

| | | | | |
|---|---|---|---|---|
| JP | 3014113 | U | | 5/1995 |
| JP | 2000-203600 | A | | 7/2000 |
| JP | 2001-301589 | A | | 10/2001 |
| JP | 2002332065 | A | * | 11/2002 |
| JP | 2003118769 | A | * | 4/2003 |
| JP | 2005-219776 | A | | 8/2005 |
| JP | 2006-44719 | A | | 2/2006 |
| JP | 2006044797 | A | | 2/2006 |
| JP | 2007210633 | A | * | 8/2007 |
| JP | 2008-30755 | A | | 2/2008 |
| TW | I103591 | | | 2/2005 |

OTHER PUBLICATIONS

Taiwanese Office Action issued in the corresponding Taiwanese Application No. 098101070 dated Aug. 12, 2011.

Japanese Office Action dated Oct. 2, 2012, issued in the corresponding Japanese Patent Application No. JP 2009-550010.

* cited by examiner

EASILY OPENABLE PACKAGING BAG

TECHNICAL FIELD

The present invention relates an easily openable packaging bag.

This application claims the benefit of Japanese Patent Application 2008-006301 filed in Japan on Jan. 15, 2008, the entire disclosure of which is incorporated by reference herein.

BACKGROUND ART

A packaging bag for foodstuffs, medicine or the like is required easily openable characteristics facilitating opening when such a bag is used. Furthermore, such a packaging bag often be required superior barrier characteristics to seal an aroma from contents filling the bag into an inner portion, or to block moisture, oxygen, light or the like from an exterior portion that will affect the properties of the contents.

A packaging bag including both easily openable characteristics and barrier characteristics includes a packing bag provided with an openable rough surface portion formed by scoring a folded portion and a rear stick portion formed along a longitudinal direction on a pillow-shaped packaging bag (Patent Literature 1).

Moreover, a packaging body that has easily openable characteristics for a rod-shaped product includes a packaging body designed so that a perforation for opening a film extends in a direction that intersects with a longitudinal direction on one longitudinal end of the packaging body, and when the packaging film of the packaging body is placed in contact with an end of the packaged material by tearing a film position on one end on an outer side of the perforation, the perforation is positioned on an outer side of a packaged material (Patent Literature 2).

[Patent Literature 1] Japanese Patent Application, First Publication No. 64-36435

[Patent Literature 2] Japanese Patent Application, First Publication No. 2008-30755

DISCLOSURE OF THE INVENTION

Problem to be Solved by the Invention

However, upon opening, the packaging bag disclosed in Patent Literature 1 is divided into a containment portion that contains contents, and a small opening piece that becomes separated from the containment portion by the opening operation. Thus, the disadvantage for handling results in that the opening piece is a small piece of waste. Furthermore this type of packaging bag must be opened using both hands. However a packaging bag which can be opening using one hand is desirable from the point of view of fashion characteristics or portability.

The packaging body in Patent Literature 2 does not take account of a packaging bag provided with barrier characteristics, and cannot be applied without modification to a packaging bag having a function of blocking moisture, oxygen, light or the like to prevent changes in the quality of contents such as foods, medicines or the like.

The present invention is proposed to provide an easily openable packaging bag which does not produce an opening piece resulting in a small piece of waste at opening operations, which facilitates opening even with a single hand, and which can be applied to a packaging bag provided with barrier characteristics.

Means for Solving the Problem

The easily openable packaging bag according to the present invention joins both ends of a packaging material into a tube shape, both of the joined ends are heat sealed to form a bonded rear portion in a side portion of the tube portion, and solid contents are contained in an inner section of the tube portion. In the tube portion, a weakened portion is provided along a circumferential direction of the tube portion in a portion not occupied by the contents, and the weakened portion is not provided in at least a portion of the bonded rear portion.

In the easily openable packaging bag according to the present invention, the shape of the weakened portion preferably has a portion in which stress is concentrated at opening.

The packaging material is a laminated film having at least an innermost layer, a functional layer and an outermost layer, and is preferably provided so that the weakened portion does not reach the functional layer.

The weakened portion is preferably formed as a broken line having discontinuous breaks.

The weakened portion is preferably formed by a convex shape portion formed as a broken line and a linear shape portion formed as a solid line having a continuous break.

The weakened portion is preferably formed by an arcuate convex shape portion and a linear shape portion extending in an outer direction of the convex shape portion from both ends of the convex shape portion. The convex shape portion concentrates stress when opening.

The linear portion preferably inclines with respect to the circumferential direction of the tube portion.

In the seal portion that closes the axial ends of the tube portion, at least the seal portion that is proximate to the weakened portion preferably is formed a seal design having a corrugated shape at least in a portion thereof.

It is preferred that the packaging material is a laminated film having at least an innermost layer and an outermost layer. A weakened portion is preferably provided on the outermost layer, and a scored portion is formed in the innermost layer in a portion corresponding to the outermost weakened portion.

The contents are preferably a whole body having a solid shape.

Effects of the Invention

The easily openable packaging bag of the present invention does not produce an opening piece resulting in a small piece of waste when opening, and facilitates opening even with a single hand. Furthermore the easily openable packaging bag of the present invention can be also applied to a packaging bag provided with barrier characteristics.

BEST MODES FOR CARRYING OUT THE INVENTION

The easily openable packaging bag according to the present invention forms a bonded rear portion on a side portion of a tube portion, and contains solid contents in an inner portion thereof. A weakened portion is provided along a circumferential direction of the tube portion in a portion not occupied by the contents in the tube portion. The weakened portion is not provided in at least a portion of the bonded rear portion.

The solid contents contained in the packaging bag according to the present invention for example include foodstuffs such as baked confectioneries, medicines or medical instruments such as syringes. The contents may be a whole body having a solid shape.

An embodiment of the easily openable packaging bag according to the present invention will be described in detail hereafter with reference to FIG. 1 to FIG. 6.

(Easily Openable Packaging Bag)

Figure 1:
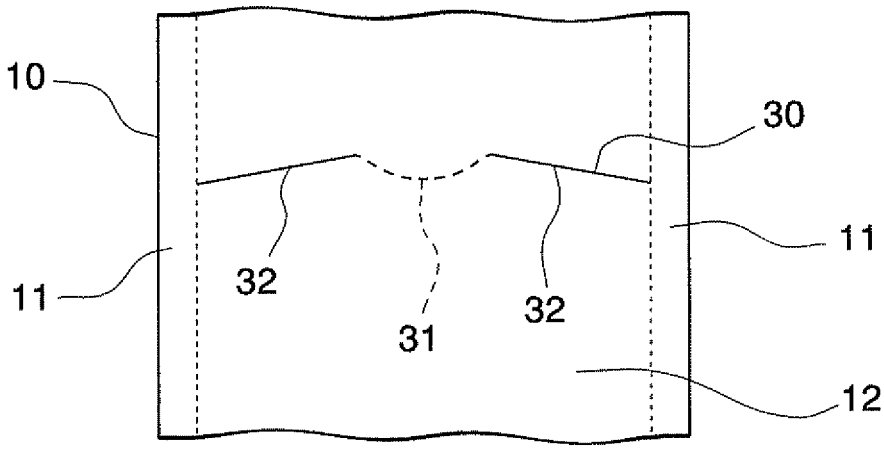
FIG. 1 is a front sectional view of packaging material used in an easily openable packaging bag according to the present invention, and shows an example of a packaging material before forming into a packaging bag.
Figure 2:
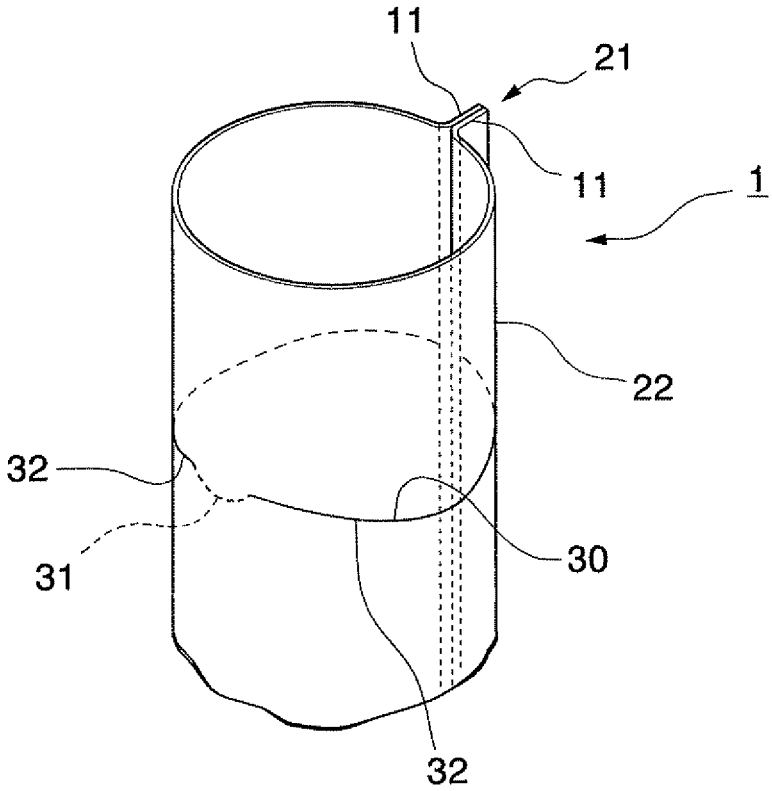
FIG. 2 is a perspective view showing the configuration of the packaging material illustrated in FIG. 1 when both ends thereof are joined and heat sealed, and formed into tube shape.
Figure 3:
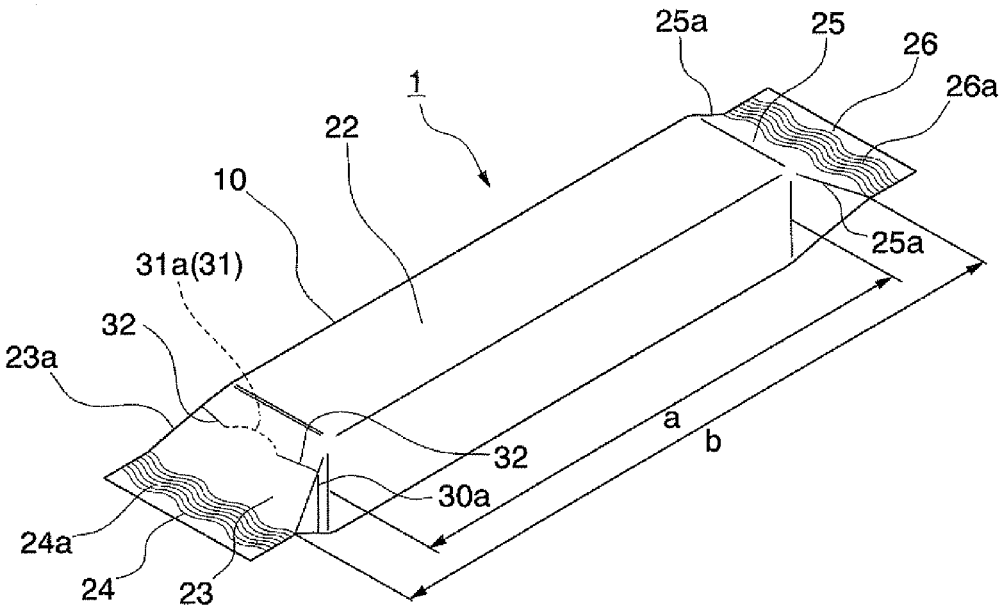
FIG. 3 is a perspective view showing an embodiment of the easily openable packaging bag according to the present invention.

As shown in FIG. 1 to FIG. 3, the easily openable packaging bag 1 (hereinafter referred to as "packaging bag 1") according to the present embodiment is a pillow-shaped packaging bag in which the same surface of the ends 11, 11 of the packaging material 10 is joined and adhered to form a tube shape, and then the joined ends 11, 11 are heat sealed to form a bonded rear portion 21 on a side portion of the tube portion 22 (corresponding to the tube forming portion 12 in FIG. 1). Moreover, the packaging bag 1 as shown in FIG. 3 heat seals the upper seal portion 24*a* of the upper portion 24 that closes the axial end and heat seals the base seal portion 26*a* of the base portion 26 that closes the axial end to thereby contain the solid contents in an inner portion.

The containment of the contents in the packaging bag 1 is enabled by heat sealing the base portion 26 and the upper portion 24 of the tube portion 22 after inserting the contents into an inner side of the tube portion 22. If the contents contained in the packaging bag 1 are solid contents, since the section of the tube portion 22 filled by the contents is extended corresponding to the thickness of the contents, when the upper portion 24 is closed, a sloping portion 23*a* is formed to the upper seal portion 24*a*, and a tube end 23 is formed necessarily that includes a space in which is not occupied by the contents. In the same manner, a sloping portion 25*a* is formed in the base portion 26 from the tube portion 22 which is expanded to the thickness of the contents to the base seal portion 26*a*, and thereby a tube end 25 is formed necessarily which has a spaced which is not occupied by the contents.

In the present invention, a weakened portion 30 (30*a*) is provided along a circumferential direction of the tube portion 22 in the tube end 23 (a portion not occupied by the contents) and is not provided in at least a portion of the bonded rear portion 21 (FIG. 1 to FIG. 3). The weakened portion 30 may be formed in the tube end 25.

The thickness of the solid contents is preferably 5-60 mm. When the thickness of the solid contents is 5 mm or more, the inner space in the tube ends 23, 25 is enlarged and thereby facilitates opening from the weakened portion 30 by application of a force by pressing the inner space. Further, when the thickness of the solid contents is 60 mm or less, an operation of applying a force to the weakened portion 30 using the thumb or the like while gripping the tube portion 22 of the packaging bag 1 with one hand is facilitated, and thereby facilitates opening of the packaging bag 1.

Moreover, when the distance from an upper seal portion 24*a* to a base seal portion 26*a* of the packaging bag 1 is denoted as b, a length of the solid contents contained in the packaging bag 1 (when the various lengths are totaled in the case of a plurality of objects) is denoted as a is preferably set that a/b is 0.7-0.9. When the value for a/b is within the above range, the formation of the tube ends 23, 25 including a space adapted for opening is facilitated, and thereby facilitates the opening of the packaging bag 1.

The packaging material 10 includes a laminated film having a single layer film or a multilayered film. Although there is no particular limitation on the packaging material 10, for the purpose of imparting various functions, it is preferred that the film is a laminated film having at least an innermost layer, a functional layer and an outermost layer.

The film used in the outermost layer of the laminated film is preferably a film displaying superior mechanical suitability and printing suitability. For example, this type of film includes stretched plastic films such as biaxially oriented polyethylene terephthalate (PET), biaxially oriented polyamide (ONY), biaxially oriented polypropylene (OPP), or the like.

The film used in the innermost layer of the laminated film is a film enabling execution of a heat seal, and for example, includes non-stretched films formed from a polyolefin resin such as low-density polyethylene (LDPE), polypropylene (PP), linear low-density polyethylene (LLDPE), or the like, a mixed resin thereof, or an ionomer resin.

Of the above resins, when the contents contained in an inner portion of the packaging bag 1 includes an oil component, use of a cast polypropylene film (CPP) displaying low oil adsorption, or a PP extrusion resin is preferred. Further, when high-speed filling characteristics are required when filling and packaging the contents, use of a non-oriented film which consists of a low melting-point resin such as an LDPE, or LLDPE resin, a mixed resin thereof, or an ionomer resin is preferred. Moreover, rather than using a non-oriented film, a film may be formed by extrusion lamination using the above resins.

The functional layer is disposed between the outermost layer and the innermost layer according to the physical properties required for the packaging bag 1. The function required for the packaging bag 1 includes barrier characteristics with respect to oxygen, moisture or the like, light shielding characteristics and impact resistant characteristics.

When gas barrier characteristics are required for the packaging bag 1, for example, a vapor deposition film including metalized vapor deposition PET, metalized vapor deposition ONY, metalized vapor deposition OPP, ceramic vapor deposition PET, ceramic vapor deposition ONY, ceramic vapor deposition OPP, or the like; a barrier film such as polyvinyl alcohol (PVOH), ethylene vinyl alcohol copolymer (EVOH), poly vinylidene chloride (PVDC), or the like, or a barrier coated film such as PVDC-coated PET, PVDC-coated ONY, PVDC-coated OPP, or the like may be used.

When light shielding characteristics are required for the packaging bag 1, for example, a metallic deposition film or a metal foil such as Al foil, Cu foil, Mg foil, or the like may be used.

When impact resistant characteristics are required for the packaging bag 1, for example, an oriented polyamide (ONY), an oriented polycarbonate (OPC), or the like may be used.

These functional layers may be used as a single layer, or combined into two or more layers.

A bonding layer such as an adhesive layer, a heat-bonding resin layer, or the like, or a printing layer or the like may be provided as required as a layer in addition to the other functional layers between the innermost layer and the outermost layer.

An actual example of packaging material 10 formed from a laminated film includes for example PET/LDPE/Al/ionomer resin or OPP/metalized vapor-disposition PET/LLDPE laminated in order from the outermost layer.

When a single layer is used as the packaging material 10, the single layer may be used a material which is given as the innermost layer.

There is no particular limitation on the thickness of the packaging material 10, and, for example, packaging material having a thickness of 27-200 μm may be used.

When a laminated film is used as the packaging material 10, it is preferred that the thickness of the outermost layer is 6-40 μm, the thickness of the innermost layer is 15-60 μm, and the thickness of the functional layer is 4-40 μm. When a bonding layer or printing layer is provided, it is preferred that the thickness of the bonding layer or printing layer is in the range of thickness of the packaging material 10. The thickness of a bonding layer provided between each of the layers forming the outermost layer, the innermost layer and the functional layer is preferably 1-30 μm.

The width of the bonded rear portion 21, that is to say, the width of the end 11 is preferably 3 to 30 mm, and more preferably 5-20 mm.

When the width of the bonded rear portion 21 is 3 mm or more, the bonded rear portion 21 is not severed at opening, that is to say, production of an opening piece can be prevented. Moreover, when the width of the bonded rear portion 21 is 30 mm or less, the design characteristics of the resulting packaging bag 1 are improved.

As shown in FIG. 2, the weakened portion 30 is formed an along circumferential direction of the tube portion 22 in a portion (the tube end 23 in FIG. 3) not occupied by the solid contents in the tube portion 22 and is not provided in at least a portion of the bonded rear portion 21. The formation of the weakened portion 30 in the tube end 23 enables the application of a force to the weakened portion 30 by pressing the space (pressing area) in an inner portion of the tube end 23 when opening. Thus opening is facilitated by the application of an efficient shearing force to the weakened portion 30. Furthermore since the weakened portion 30 is omitted from at least a portion of the bonded rear portion 21, the bonded rear portion 21 does not become severed at opening and the upper portion 24 does not separate, and thereby an opening piece resulting in a small piece of waste does not be produced.

There is no particular limitation with respect to the weakened portion 30, and for example, a weakened portion (perforation) formed as a broken line having discontinuous breaks may be used. When the packaging material 10 includes a functional layer is provided to impart a function such as a gas barrier property, the weakened portion 30 is adapted not to reach the functional layer. In this manner, the provision of the weakened portion 30 further facilitates opening without adversely affecting functionality such as barrier characteristics. To prevent damage such as cutting or the like at a section of the weakened portion 30 as a result of an impact during manufacture or the like, or due to fall or during transportation, the weakened portion 30 is preferably formed not to be overly deep irrespective of the presence or absence of the above type of functional layer.

A broken-line weakened portion may be formed by a mechanical process using a metallic processing cutter or the like, or by laser processing.

When providing a broken-line weakened portion as the weakened portion 30, from the point of view of further facilitating opening, a ratio c/d of the length c of the breaks and the interval d between the breaks is preferably 1-25, and more preferably 3-7. When the ratio c/d is 1 or more, opening with a single hand is facilitated. When the ratio c/d is 25 or less, stress during opening tends to concentrate on a section of the end of each break and thereby facilitates opening.

The length c of the breaks is preferably 1-5 mm. The interval d between a break and a break is preferably 0.2-1 mm. The length c of the breaks and the interval d between a break and a break may be varied midway. Furthermore the weakened portion 30 may form the break as a continuous solid line, or may combine a broken line with a solid line.

From the point of view of particularly improving the ease of opening and extracting contents, it is preferred that the weakened portion 30 encircles the tube portion 22.

Further, when in a range in which the ease of opening and extracting contents is not conspicuously adversely affected, the weakened portion 30 is not encircled, and a portion in which the weakened portion 30 is not formed may be provided in proximity to the bonded rear portion 21 of the packaging bag 1. In other words, in FIG. 1, the weakened portion 30 may be provided not to reach both ends 11, 11. In this case, the weakened portion 30 is preferably formed as more a semi-circle in relation to the tube portion 22.

Moreover, when in a range in which the bonded rear portion 21 is easily cut at opening, and an opening piece is not formed, a portion of the weakened portion 30 may reach a portion of the bonded rear portion 21.

Although there is no particular limitation on the shape of the weakened portion 30 and the weakened portion may be formed in a linear shape, from the point of view of facilitating opening even when using a single hand, it is preferred that the shape includes a portion which concentrates stress at opening. The portion which concentrates stress may merely be at least a section of the weakened portion 30 that concentrates stress when applying a force at opening in comparison to other portions and there is no particular limitation on the shape thereof. For example, a convex shape portion 31 or the like may be used, and of such shapes, an arcuate convex shape portion 31*a* (FIG. 3) enabling easy opening is preferred. Furthermore a preferred weakened portion 30 is a weakened portion 30*a* that includes an arcuate convex shape portion 31*a* in an intermediate portion, and that includes a linear portion 32 extending from both ends of the arcuate convex shape portion 31*a* to an outer direction of the respective arcuate convex shape portions 31*a* (FIGS. 1-3, and FIG. 5). In the arcuate convex shape portion 31*a*, when forming the curve as a circle, the center of the circle is positioned on opposite sides of a midpoint of the curve about a line connecting both terminal ends of the arcuate convex shape portion 31*a*.

In the weakened portion 30*a*, when a force is applied in the proximity of the weakened portion 30*a* when opening the packaging bag 1, opening is facilitated due to the concentration of the stress on the arcuate convex shape portion 31*a*. Furthermore the arcuate convex shape portion 31*a* facilitates opening since the stress tends to be transmitted suitably to the linear portion 32.

Figure 5A:
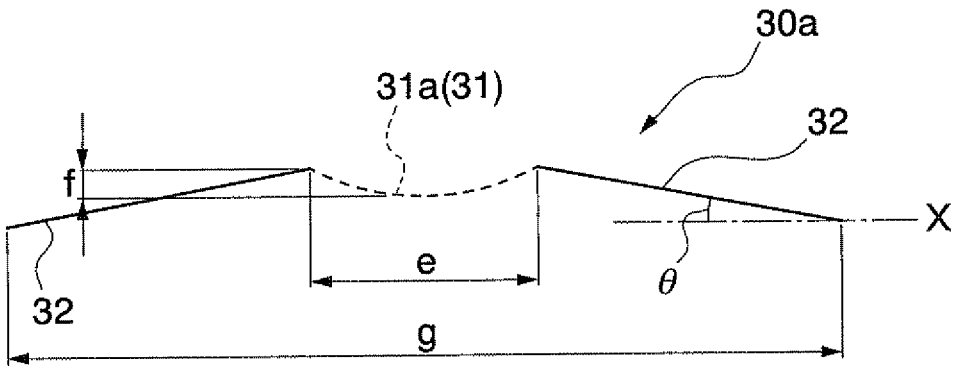
FIG. 5A is a front sectional view showing an embodiment of the shape of a weakened portion according to the present invention.

As shown in FIG. 5A, the linear portion 32 preferably provided with a slope relative to the circumferential direction X of the tube portion 22. Since the linear portion 32 is provided with a slope, the stress when opening tends to be concentrated by the arcuate convex shape portion 31*a* to thereby further facilitate the opening of the packaging bag 1. From the point of view of the arcuate convex shape portion 31*a* enabling concentration of a stress, the slope of the linear portion 32 preferably slopes with respect to the convex direction of the arcuate convex shape portion 31*a* (FIG. 5A).

The inclination angle θ of the linear portion 32 relative to the circumferential direction X is preferably 1-45°, that is to say, tan θ=0.017-1.000. When the inclination angle θ is 1° or more, since the difference of the arcuate convex shape portion 31*a* and the linear portion 32 is clear, stress tends to be concentrated in the arcuate convex shape portion 31*a* and therefore facilitates opening of the packaging bag 1. When the inclination angle θ is 45° or less, since the distance which the linear portion 32 reaches the bonded rear portion 21 is short, opening of the packaging bag 1 is facilitated since the linear portion 32 can be easily severed during opening with a single hand.

In the weakened portion 30*a*, it is preferred that the arcuate convex shape portion 31*a* is formed as a broken line and that the linear portion 32 is formed as a solid line having a continuous break. The configuration of the arcuate convex shape portion 31*a* as a broken line causes a further concentration of stress when opening in a portion of the end of the respective breaks forming the arcuate convex shape portion 31*a*, and further facilitates the opening.

The configuration of the linear portion 32 as a solid line having continuous breaks further facilitates the transmission of the opening operation. Thus after applying stress to open the arcuate convex shape portion 31*a*, opening is further facilitated by the simple transmission of that opening operation to the linear portion 32.

As with the broken line portion, the solid line portion in the weakened portion 30 may be formed by a mechanical process using a metallic processing cutter or the like, or by laser processing.

A width e of the arcuate convex shape portion 31*a* (FIG. 5A) is preferably 5-30 mm. When the width e of the arcuate convex shape portion 31*a* is 5 mm or more, if opening is executed by pressing with the fingers on the arcuate convex shape portion 31*a*, pressing only on the arcuate convex shape portion 31*a* is possible without pressing with the fingers at the same time on the linear portion 32 on both ends of the arcuate convex shape portion 31*a*. Therefore a concentrated force tends to be applied onto the arcuate convex shape portion 31*a*, the stress applied when opening tends to be concentrated on the arcuate convex shape portion 31*a* and opening of the packaging bag 1 is easy. Furthermore when the width e of the arcuate convex shape portion 31*a* is 30 mm or less, the force of pressing when opening is sufficiently applied to the whole of the arcuate convex shape portion 31*a* and thereby facilitates opening of the packaging bag 1.

A height f of the arcuate convex shape portion 31*a* (FIG. 5A) is preferably 0-5 mm, and in particular, is preferably 0.1-0.5 mm. When the height f of the arcuate convex shape portion 31*a* is 0 mm, the difference relative to the linear portion 32 becomes clear by increasing the inclination angle θ of the linear portion 32. When the height f of the arcuate convex shape portion 31*a* is 0.1 mm or more, since the difference relative to the linear portion 32 is clear irrespective of the value of the inclination angle θ of the linear portion 32, the stress tends to be concentrated on the arcuate convex shape portion 31*a*, and opening of the packaging bag 1 is facilitated. Furthermore when the height f of the arcuate convex shape portion 31*a* is 5 mm or less, the force applied at opening tends to be sufficiently applied to the whole of the arcuate convex shape portion 31*a* and thereby facilitates opening of the packaging bag 1.

Figure 5B:
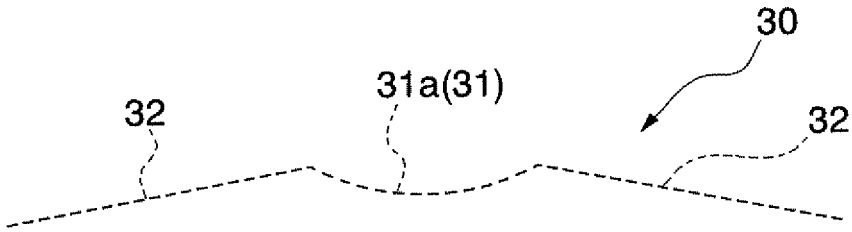
FIG. 5B is a front sectional view showing another embodiment of the shape of the weakened portion according to the present invention.
Figure 5C:
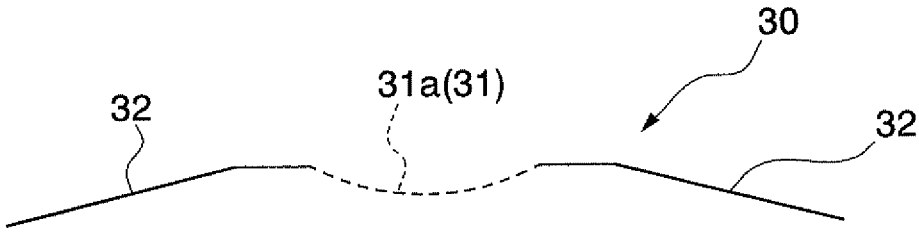
FIG. 5C is a front sectional view showing another embodiment of the shape of the weakened portion according to the present invention.

The weakened portion 30 is not limited to the configuration illustrated in the example in FIG. 5A and includes a configuration in which the arcuate convex shape portion 31 and the linear portion 32 are both formed as a broken line (FIG. 5B), or the linear portion 32 may have the configuration in which a linear portion is formed along the circumferential direction from the convex shape portion 31, and then an inclined portion that inclines from an intermediate portion may be formed (FIG. 5C).

When the weakened portion 30 is formed as shown in FIG. 5C, the linear portion and the inclined portion of the linear portion 32 may include a break in the shape of a broken line, or may be a solid line, and preferably, the linear portion is formed as a broken line and the inclined portion is formed as a solid line.

Figure 6A:
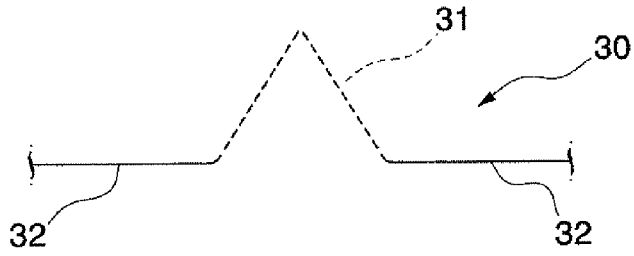
FIG. 6A is a front sectional view showing another embodiment of the shape of the weakened portion according to the present invention.
Figure 6B:
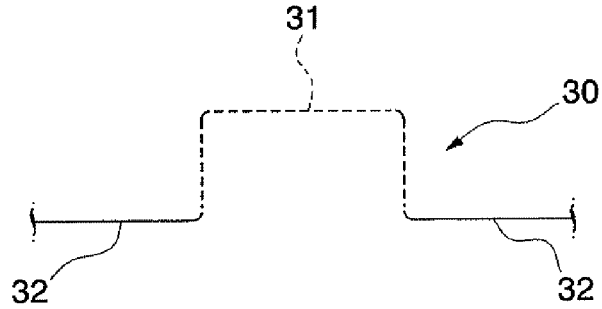
FIG. 6B is a front sectional view showing another embodiment of the shape of the weakened portion according to the present invention.

The shape of the portion in which stress on the weakened portion 30 is not limited to the weakened portion 30*a* as long as the portion which the stress concentrates is provided. For example, such a shape may include a convex shape having a broken line shape that is curved to form a single angle (FIG. 6A), or a convex shape curved to form two right-angles (FIG. 6B).

Figure 6C:
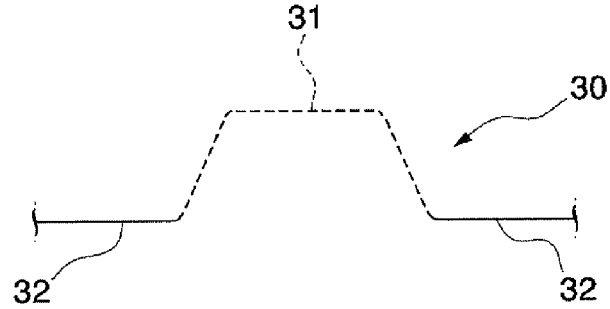
FIG. 6C is a front sectional view showing another embodiment of the shape of the weakened portion according to the present invention.

As shown in FIG. 6C, a convex shape may be formed to have two angles and a width which decreases towards a top end. In this type of shape, the angle of the linear portion 32 and the inclined portion of the convex shape portion 31 is further increased and becomes obtuse and thereby more suitably transmits the stress concentrated on the convex shape portion 31 to the linear portion 32.

Figure 6D:
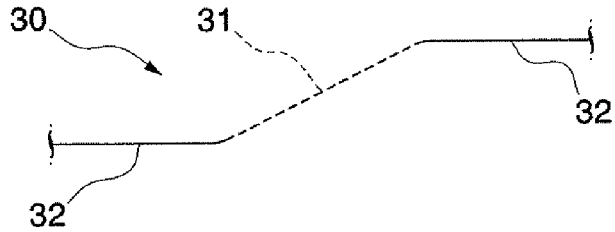
FIG. 6D is a front sectional view showing another embodiment of the shape of the weakened portion according to the present invention.

As shown in FIG. 6D, the linear portions 32 may be connected as straight lines without forming the linear portion 32 on a single line. This type of shape enables the shape of the metallic processing cutter or the laser orbit to be simplified.

Figure 6E:
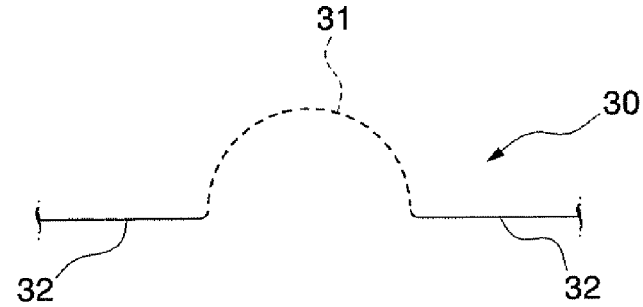
FIG. 6E is a front sectional view showing another embodiment of the shape of the weakened portion according to the present invention.

A semicircular shape may be used in which the center when forming the arc as a circle is on the line connecting the terminals of the arcuate convex shape portion 31*a* (FIG. 6E).

FIGS. 6A-6E illustrate examples in which linear portion 32 is not inclined. However the linear portion 32 may be inclined.

Figure 4:
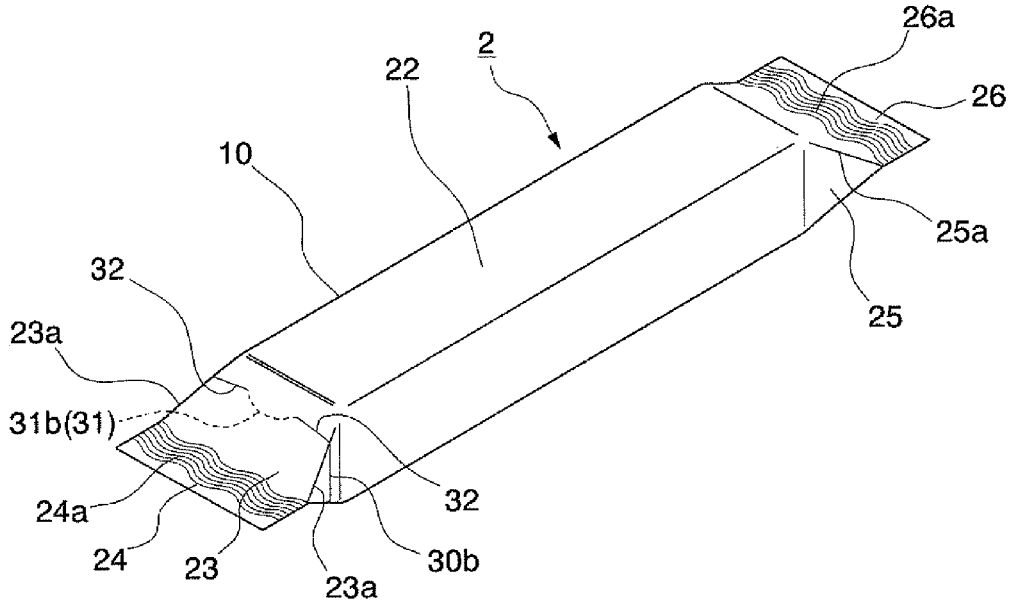
FIG. 4 is a perspective view showing another embodiment of the easily openable packaging bag according to the present invention.

Although the weakened portion 30*a* of the packaging bag 1 forms the arcuate convex shape portion 31*a* towards the base portion 26, that is to say, towards a center direction of the tube portion 22, a weakened portion 30*b* having a convex shape portion 31*b* formed towards the upper portion 24 such as a packaging bag 2 illustrated in FIG. 4 may be formed. Furthermore two or more convex shape portions 31 (31*a*, 31*b*) may be formed, and the convex shape portions 31 are formed continuously or a fixed interval may be provided.

Figure 7:
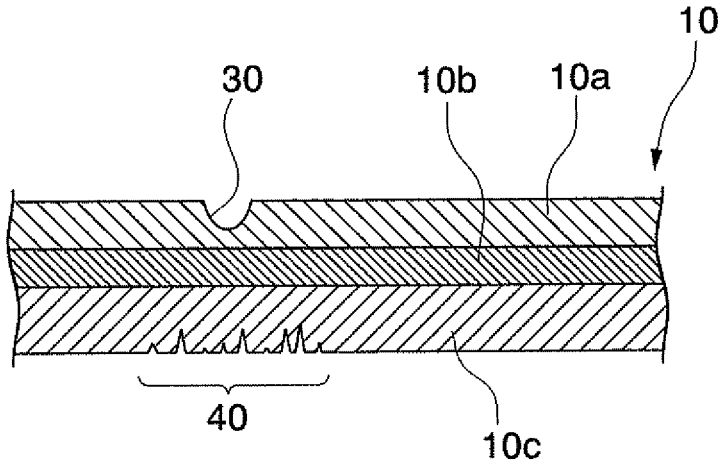
FIG. 7 is a sectional view showing a weakened portion and a scored portion of the easily openable packaging bag according to the present invention.

When the packaging material 10 of the packaging bag 1 is a laminated film having at least an innermost layer and an outermost layer, it is preferred that the weakened portion 30 is provided on the outermost layer, and a scored portion 40 is provided at a position on the innermost layer corresponding to the weakened portion on the outermost layer. For example, as shown in FIG. 7, when the packaging material 10 includes an innermost layer 10*c*, a functional layer 10*b* and an outermost layer 10*a*, it is preferred that a scored portion 40 is provided on the innermost layer 10*c* at a position corresponding to the weakened portion 30 on the outermost layer 10*a*. As long as the scored portion 40 is provided at a position corresponding to the weakened portion 30, it may be provided in a broader range than the weakened portion 30. In this manner, since the film forming the innermost layer 10*c* can be easily severed, opening of the packaging bag 1 is further facilitated. When the packaging material 10 includes a functional layer 10*b*, the scored portion 40 may be formed not to reach the functional layer 10*b* as shown in FIG. 7.

The scored portion 40 for example can be formed using a metallic processing cutter, sandpaper, a grindstone, or the like.

There is no particular limitation on the shape of the seal design of the seal portion that seals the axial end in the tube portion 22, and the shape may include a corrugated shape as illustrated in FIG. 3, a linear shape in a width direction, a linear shape in an axial direction, a lattice shape formed from straight lines in an axial and width direction, or a planar seal shape. These shapes may be combined. The corrugated shape may include a plurality of corrugations, or a plurality of seal lines may be formed in the respective shapes. A seal design as used herein denotes a pressing trace of a heat seal bar when executing a heat seal, and a seal line as used herein denotes each undulation of the respective seal design. In the upper seal portion 24*a* which is proximate to the weakened portion 30 of the seal portion closing the axial end, the section corresponding to the arcuate convex shape portion 31*a* in at least an axial direction is preferably a corrugated seal design (for example, FIG. 3).

By sealing the upper seal portion 24*a* in this configuration, since the undulating portion in a corrugated shape functions as an anti-slip for the thumb that presses the arcuate convex shape portion 31*a* when opening the packaging bag 1, opening of the packaging bag 1 is facilitated since stress can be effectively applied to the weakened portion 30. When a weakened portion 30 is provided in the tube end 25, the portion in the base seal portion 26*a* that corresponds to the arcuate convex shape portion 31*a* at least in an axial direction is preferably a corrugated seal design. The upper seal portion 24*a* and the base seal portion 26*a* is preferably the same seal design from the point of view of design characteristics.

The easily openable package bag according to the present invention may be an envelope packaging bag which has a bonded portion which is formed by joining and laminating different faces of the respective ends 11, 11 of the packaging material 10, that is to say the outermost surface and the innermost surface to form a tube shape and then, heat seal a bonded rear portion of the ends 11, 11. Even when formed as an envelope packaging bag, since a weakened portion is formed along a circumferential direction of the tube portion in a portion not occupied by the solid contents in the tube portion and is formed that the weakened portion is not provided in at least a portion of the bonded rear portion in the same manner as the packaging bag 1 above, opening is easy and fine opening pieces during opening are not produced. Furthermore the ease of opening is further improved by forming the shape of the weakened portion into a shape in which stress at opening becomes concentrated.

(Method of Manufacturing)

A method of manufacturing the packaging bag according to the present embodiment will be described hereafter. In addition, a method of manufacturing the packaging bag is not limited below.

When using a laminated film as the packaging material 10, a film which forms an outermost layer and an innermost layer, and in addition, a functional layer as required is used in a dry lamination method or an extrusion lamination method to prepare a film laminated body.

Next, a band-shaped packaging material 10 is obtained by cutting the resulting film laminated body (FIG. 1). Thereafter, a weakened portion 30 oriented in a shorter direction is formed on the tube forming portion 12 on the outermost surface of the packaging material 10 by mechanical processing with a metallic processing cutter or by laser processing. A weakened portion 30 is not provided on the ends 11, 11 positioned in the shorter direction at this time.

The method of forming the weakened portion 30 is preferably laser processing in view of facilitating the processing of the non-linear portions (the arcuate convex shape portion 31*a* and the like), and of those processes, processing using a carbon dioxide laser is preferred.

Then, the packaging material 10 is formed into a tube shape with the innermost layer as an inner side. Then, the innermost layers of the ends 11, 11 of the packaging material 10 are joined to thereby adhere, and the adhered ends 11, 11 are heat sealed to form a bonded rear portion 21 (FIG. 2). Thereafter, the upper seal portion 24*a* which forms the upper portion 24, and the base seal portion 26*a* which forms the base portion 26 of the packaging bag 1 are heat sealed to obtain a packaging bag 1 (FIG. 3).

The method of filling the solid contents into the packaging bag 1 includes a filling method by enclosing in an inner side of the innermost layer of the packaging material 10 when the packaging material 10 is formed into a tube shape during the process of forming the bonded rear portion 21, or a filling method may be used in which after sealing either one of the upper seal portion 24*a* or the base seal portion 26*a*, the contents are filled and, then the other of the upper seal portion 24*a* or the base seal portion 26*a* is heat sealed.

(Opening Method)

Figure 8A:
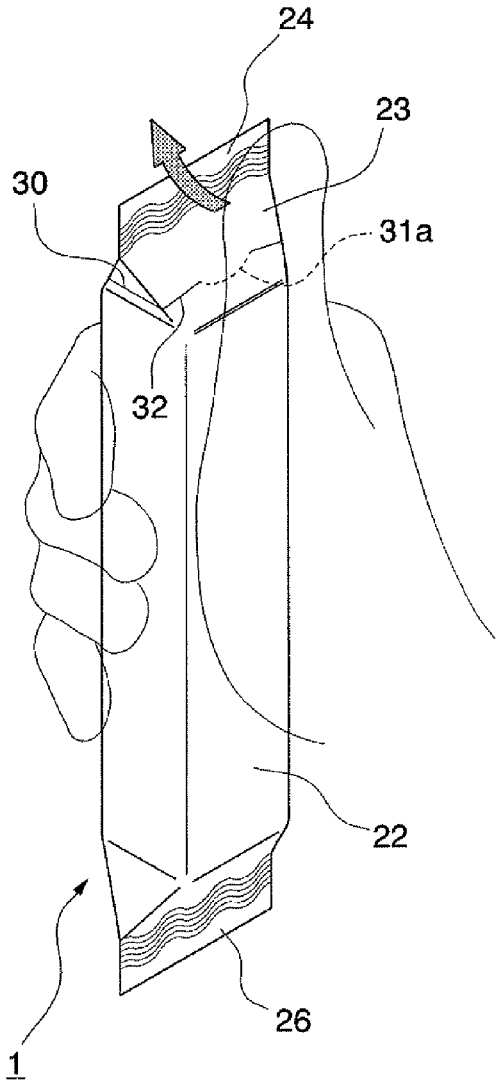
FIG. 8A is a perspective view showing the configuration of the easily openable packaging bag illustrated in FIG. 3 when opened using a single hand.
Figure 8B:
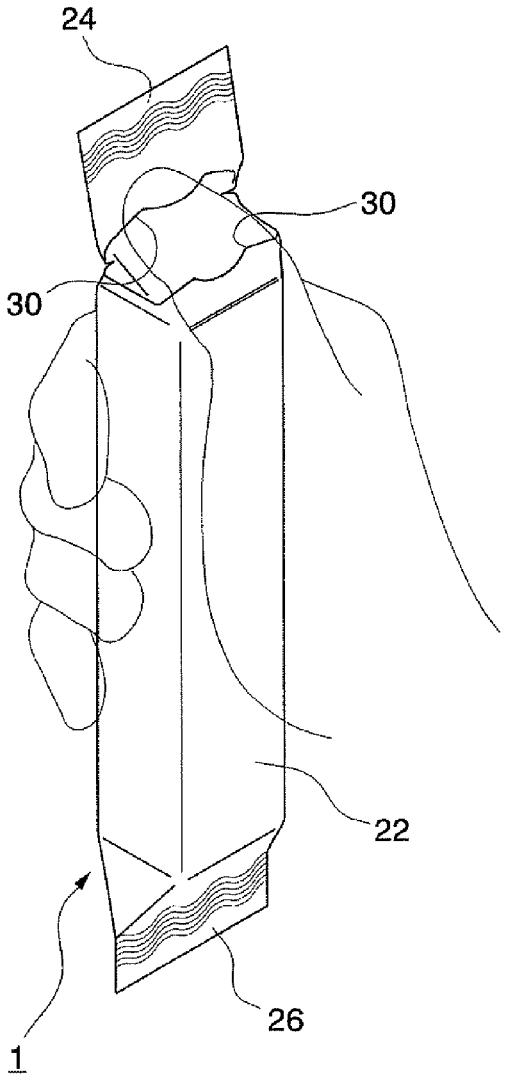
FIG. 8B is a perspective view showing the configuration of the easily openable packaging bag illustrated in FIG. 3 when opened using a single hand.
Figure 9A:
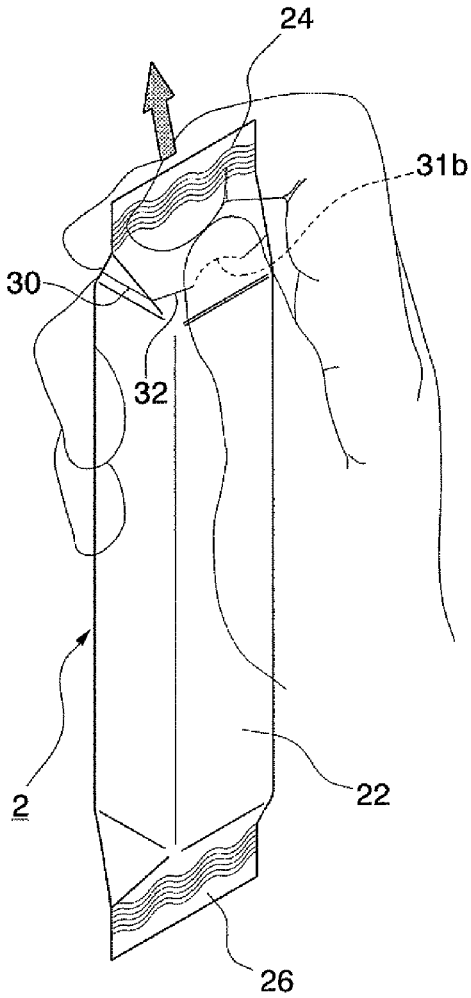
FIG. 9A is a perspective view showing the configuration of the easily openable packaging bag illustrated in FIG. 4 when opened using a single hand.
Figure 9B:
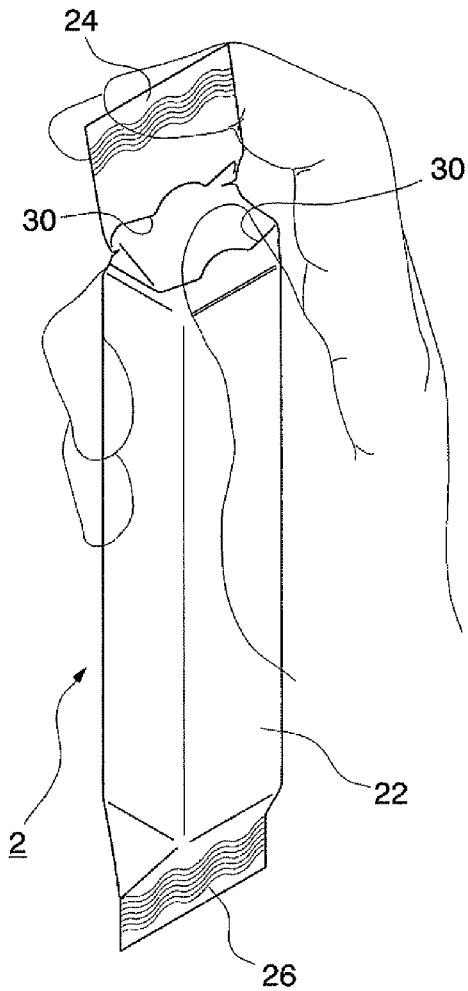
FIG. 9B is a perspective view showing the configuration of the easily openable packaging bag illustrated in FIG. 4 when opened using a single hand.

The method of opening the easily openable packaging bag according to the present invention will be described with reference to FIG. 8 and FIG. 9. FIG. 8 is a perspective view showing the configuration of the packaging bag 1 when opened using a single hand. FIG. 9 is a perspective view showing the configuration of the packaging bag 2 when opened using a single hand.

As shown in FIG. 8, the packaging bag 1 is opened by gripping the tube portion 22 and using a thumb to apply a pressure by pressing the arcuate convex shape portion 31*a* into an inner portion of the tube portion 22 (the inner portion of the tube end 23). In this manner, a break is formed by concentration of stress on the arcuate convex shape portion 31*a* and application of a shearing stress. Further pressing with the thumb also shears the linear portion 32 and thereby opens the packaging bag 1. Since a weakened portion 30 is not provided in the bonded rear portion 21 at this time, a weakened portion 30 does not shear, the upper portion 24 does not separate from the tube portion 22. Consequently an opening piece forming a small piece of waste is not produced.

As shown in FIG. 9, when opening the packaging bag 2, the tube portion 22 is gripped by using the index finger and the middle finger to sandwich the upper portion 24 while pressing the convex shape portion 31*b* with the thumb. In that state, a force is applied by raising the upper portion 24 upwardly with the index finger and the middle finger, and depressing the convex shape portion 31*b* with the thumb at the same time. In this manner, concentration of stress in the convex shape portion 31*b* and application of a shearing stress cause a break in the weakened portion 30 and thereby opens the packaging bag 2. In the same manner as the packaging bag 1, since a weakened portion 30 is not provided in the bonded rear portion 21, the upper portion 24 does not separate from the tube portion 22 and therefore an opening piece forming a small piece of waste is not produced.

The packaging bag 1 and the packaging bag 2 can be easily opened with a single hand using a method as described above.

The easily openable packaging bag according to the present invention as described above can be easily opened with a single hand and has the handling advantage that an opening piece forming a small piece of waste is not produced during opening. Furthermore the easily openable packaging bag according to the present invention can be applied when using a laminated film in which the packaging material includes a functional layer.

EMBODIMENTS

The present invention as described in the embodiments will be described in further detail below. However the present is not limited to the following description.

First Embodiment

The packaging material 10 is prepared using a dry lamination method and an extrusion lamination method on a laminated film formed in order from an outermost layer by PET (16 μm)/a printing layer/an adhesive layer (1 μm)/Al (7 μm)/LDPE (60 μm), and then cutting (vertical 155 mm×horizontal 115 mm).

Then carbon dioxide laser processing is used to form a weakened portion 30 in the tube forming portion 12 except for both ends 11, 11 (width 10 mm) in the packaging material 10. The shape of the resulting weakened portion 30 includes an arcuate convex shape portion 31*a* having a protrusion toward the base portion 26 of the tube portion 22 when forming the packaging bag, and a linear portion 32 inclining on both sides of the arcuate convex shape portion 31*a* (FIG. 1 and FIG. 5A). The arcuate convex shape portion 31*a* is formed as a broken line, and the linear portion 32 is formed as a solid line. The width e of the arcuate convex shape portion 31*a* is 20 mm, the height f is 0.5 mm (the radius of circular arc: 80 mm). The circumferential length g of the weakened portion 30 is 80 mm (FIG. 5A). The linear portions 32 on both sides of the arcuate convex shape portion 31*a* both have a circumferential length of 30 mm and an inclination angle θ in a shorter direction (corresponding to the circumferential direction X of the tube portion 22) is tan θ=4/30. The broken line portion of the arcuate convex shape portion 31*a* has a break length c of 1 mm, and an interval d from break to break of 0.5 mm.

Then the packaging material 10 is used to form a bonded rear portion 21 by placing on an inner side the LDPE layer which is the innermost layer, and then laminating so that the LDPE layers of both ends 11, 11 are joined to form a tube shape and then the joined ends 11, 11 are heat sealed (FIG. 2).

Then in state of an inner portion being filled using a baked confectionery as solid contents, the upper seal portion 24*a* and the base seal portion 26*a* are heat sealed using a heat sealing bar that enables formation of corrugated seal design to thereby form the packaging bag 1 (packaging bag 1A) (FIG. 3).

The packaging bag 1A is opened using a single hand as shown in FIG. 8. More specifically, opening is executed by gripping the tube portion 22 and applying a force by using a thumb to press the arcuate convex shape portion 31*a* towards an inner portion of the tube portion 22 (the inner portion of the tube end portion 23). Opening can be executed in an extremely simple manner without severing the upper portion of the bonded rear portion 21 or producing residual upper portion 24 and therefore a small opening piece is not produced.

Second Embodiment

A packaging bag 1B was prepared in the same manner as the first embodiment with the exception that the broken line portion of the arcuate convex shape portion 31*a* has a break length c of 0.8 mm and an interval d from break to break is 0.3 mm.

When the resulting packaging bag 1B is opened in the same manner as the first embodiment, opening can be executed in an extremely simple manner without severing the portion of the bonded rear portion 21 or producing residual upper portion 24 and therefore a small opening piece is not produced.

Third Embodiment

A packaging bag 1C was prepared in the same manner as the first embodiment with the exception that both the arcuate convex shape portion 31*a* and the linear portion 32 are formed as a broken line (FIG. 5B).

When the resulting packaging bag 1C is opened in the same manner as the first embodiment, opening can be executed in an extremely simple manner without severing the portion of the bonded rear portion 21 or producing a residual upper portion 24 and therefore a small opening piece is not produced.

Fourth Embodiment

A packaging bag 1D was prepared in the same manner as the second embodiment with the exception that the linear portion 32 is formed as a broken line from the arcuate convex shape portion 31*a* along the shorter direction (corresponding to the circumferential direction X of the tube portion 22) and thereafter inclines to form a solid line (FIG. 5C). The length of the portion of the linear portion 32 along the shorter direction is 10 mm and the inclination angle θ of the inclined portion is tan θ=4/20. The broken line portion of the arcuate convex shape portion 31*a* has a break length c of 0.8 mm, and an interval d from break to break of 0.3 mm. The broken line portion in the portion of the linear portion 32 along the shorter direction has a length c of 1 mm and an interval d from break to break of 0.3 mm.

When the resulting packaging bag 1D is opened in the same manner as the first embodiment, opening can be executed in an extremely simple manner without severing the portion of the bonded rear portion 21 or producing a residual upper portion 24 and therefore a small opening piece is not produced.

Fifth Embodiment

The packaging material 10 is prepared using a dry lamination method and an extrusion lamination method on a laminated film formed in order from an outermost layer by PET (16 μm)/a printing layer/an adhesive layer (1 μm)/Al (7 μm)/LDPE (60 μm), and then cutting (vertical 155 mm×horizontal 115 mm).

Then carbon dioxide laser processing is used to form a weakened portion 30 as a broken line along a shorter direction in the tube forming portion 12 except for both ends 11, 11 (width 10 mm) in the packaging material 10. The shape of the resulting weakened portion 30 includes a semicircular convex shape portion 31 protruding towards the base portion 26 of the tube portion 22 when forming the packaging bag, and a linear portion 32 along a shorter direction on both sides of the convex shape portion 31 (FIG. 6E). The broken line portion of the convex shape portion 31 has a break length c of 1 mm and an interval d between breaks of 0.5 mm.

Figure 10:
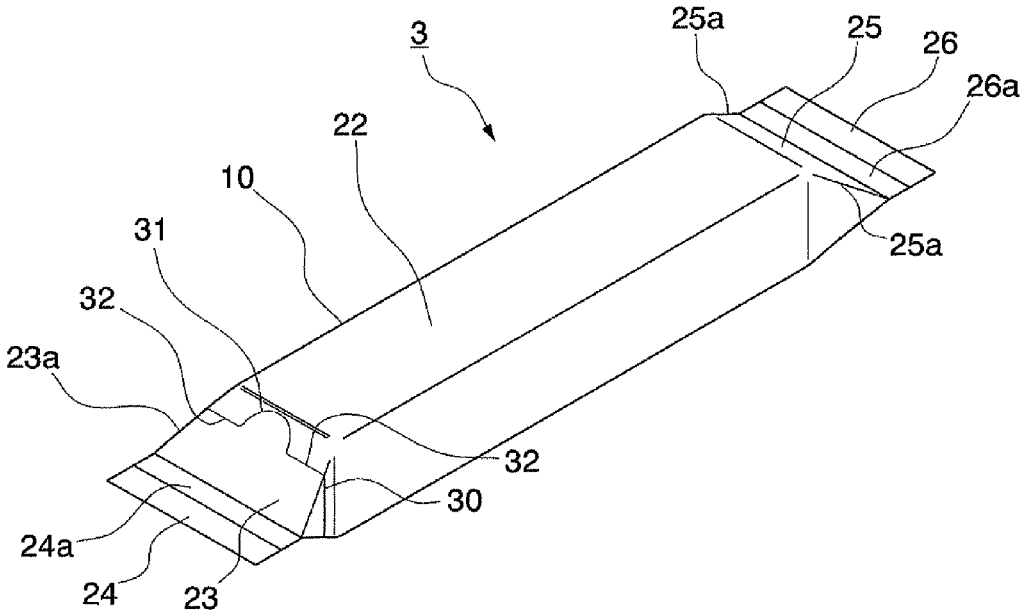
FIG. 10 is a perspective view showing the easily openable packaging bag 3 according to a first embodiment.

Then the packaging material 10 is used to form a bonded rear portion 21 by making the LDPE layer which is the innermost layer an inner side, and then laminating so that the LDPE layers of both ends 11, 11 are joined to form a tube shape and then the bonded ends 11, 11 are heat sealed. Then the packaging bag 3 is prepared by filling an inner portion using a baked confectionery as solid contents, and then heat sealing the upper seal portion 24*a* and the base seal portion 26*a* so that the seal surface has a planar shape (FIG. 10).

The packaging bag 3 is opened using one hand in the same manner as the first embodiment. More specifically, opening is executed by gripping the tube portion 22 and applying a force by using a thumb to press the arcuate convex shape portion 31*a* towards an inner portion of the tube portion 22 (the inner portion of the tube end portion 23). Opening can be executed in an extremely simple manner without severing the upper portion of the bonded rear portion 21 or producing residual upper portion 24 and therefore a small opening piece is not produced.

Sixth Embodiment

Figure 11:
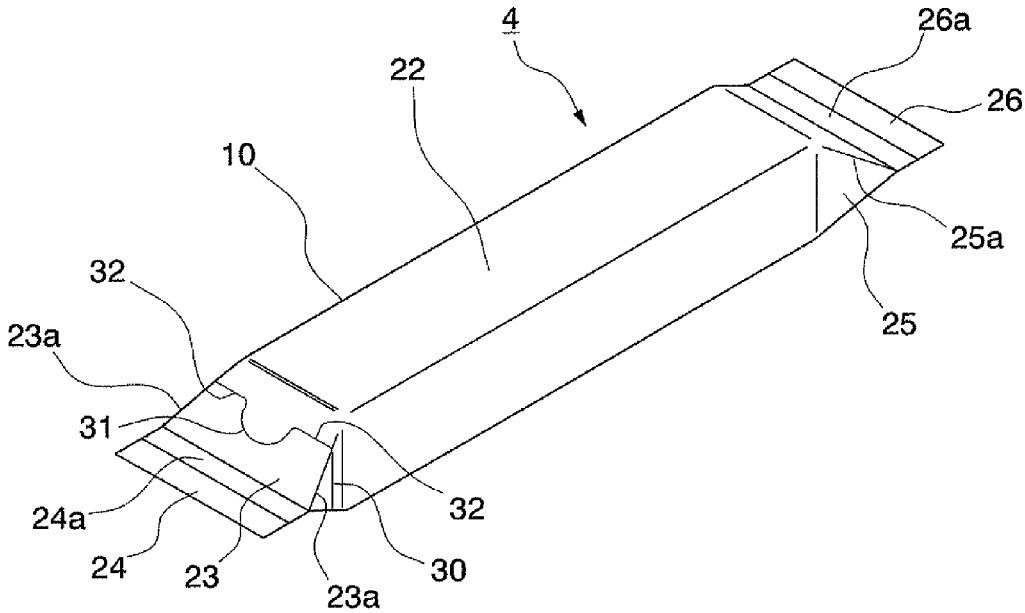
FIG. 11 is a perspective view showing the easily openable packaging bag 4 according to a second embodiment.

A packaging bag 4 was prepared in the same manner as the fifth embodiment using the same packaging material as the fifth embodiment with the exception that the shape of the formed weakened portion 30 has a shape including a semicircular convex shape portion 31 forming a protrusion towards an upper portion 24 of the tube portion 22 when forming the packaging bag, and a linear portion 32 formed along a shorter direction on both sides of the convex shape portion 31*b* (FIG. 11).

The packaging bag 4 is opened with a single hand using a method exemplified in FIG. 9. More specifically, the tube portion 22 is gripped by using the index finger and the middle finger to sandwich the upper portion 24 while pressing the convex shape portion 31*b* with the thumb. In that state, a force is applied by raising the upper portion 24 upwardly with the index finger and the middle finger, and depressing the convex shape portion 31*b* with the thumb at the same time.

Opening can be executed in a simple manner without severing the portion of the bonded rear portion 21 or producing residual upper portion 24 and therefore a small opening piece is not produced.

Furthermore when the first to the sixth embodiments are compared, opening of the packaging bag 1A, 1B in the first and the second embodiments is particularly easy, and the packaging bags 1C, 1D are easier to open than the packaging bags 3, 4.

INDUSTRIAL APPLICABILITY

Since an easily openable packaging bag according to the present invention enables simple opening with a single hand, a packaging bag having excellent fashion characteristics and portability can be produced. Furthermore since opening pieces forming a small piece of waste are not produced, the packaging bag can be suitable used in relation to foods and the like. Furthermore, suitable use as a packaging bag for medical devices and the like is enabled due to simplicity of opening, convenience resulting from no production of opening pieces and the addition of a functional layer as a barrier layer or the like.

The invention claimed is:

1. An easily openable packaging bag joining both ends of a packaging material into a tube shape, both of the joined ends heat sealed to form a bonded rear portion in a side portion of the tube portion, and containing solid contents in an inner section of the tube portion, wherein:

a weakened portion is formed in a portion not occupied by the contents in the tube portion along a circumferential direction of the tube portion, the weakened portion is not provided in at least a portion of the bonded rear portion, the weakened portion is configured by a convex shape portion formed as a broken line and a linear portion formed as a solid line having a continuous break.

2. The easily openable packaging bag according to claim 1, wherein:

the linear portion is configured to incline with respect to the circumferential direction of the tube portion.

* * * * *